US007322872B2

(12) United States Patent
Butler et al.

(10) Patent No.: US 7,322,872 B2
(45) Date of Patent: Jan. 29, 2008

(54) MODEL TOY AIRCRAFT

(76) Inventors: Ernest Butler, 1701 SE. 6th St., Mineral Wells, TX (US) 76067; Michael Connally, 1206 Lynn St., Weatherford, TX (US) 76086

( * ) Notice: Subject to any disclaimer, the term of this patent is extended or adjusted under 35 U.S.C. 154(b) by 0 days.

(21) Appl. No.: 11/481,594

(22) Filed: Jul. 6, 2006

(65) Prior Publication Data

US 2007/0010159 A1 Jan. 11, 2007

Related U.S. Application Data

(63) Continuation-in-part of application No. 11/373,706, filed on Mar. 10, 2006.

(60) Provisional application No. 60/697,154, filed on Jul. 7, 2005.

(51) Int. Cl.
*A63H 27/00* (2006.01)

(52) U.S. Cl. ..... 446/57; 446/454

(58) Field of Classification Search ..... 114/272, 114/274; 244/105, 106; D21/542, 447, 446; D12/319, 324; 446/61, 57, 454, 456
See application file for complete search history.

(56) References Cited

U.S. PATENT DOCUMENTS 3,190,582 A 6/1965 Lippisch
3,627,235 A 12/1971 Lippisch
D235,858 S * 7/1975 Lyford, III ..... D12/311
4,712,630 A * 12/1987 Blum ..... 180/117
5,242,132 A 9/1993 Wukowitz
5,277,383 A * 1/1994 Tormakhov et al. ..... 244/106
5,415,365 A * 5/1995 Ratliff ..... 244/101
5,562,061 A * 10/1996 Crocker ..... 114/43
5,622,133 A * 4/1997 Sinitsyn et al. ..... 114/272
5,697,468 A 12/1997 Russell et al.
6,029,929 A 2/2000 Blum et al.
6,409,122 B1 6/2002 Nicholai
6,581,536 B1 * 6/2003 Belloso ..... 114/61.1
6,592,073 B1 7/2003 Meekins
6,612,893 B2 9/2003 Rehkemper et al.
6,732,672 B2 5/2004 Shin et al.
D504,921 S * 5/2005 Wei ..... D21/542
7,073,750 B1 * 7/2006 Choi ..... 244/13
2002/0106961 A1 * 8/2002 Barthold ..... 446/36

* cited by examiner

*Primary Examiner*—Robert E. Pezzuto
*Assistant Examiner*—Alex F. R. P. Rada, II
(74) *Attorney, Agent, or Firm*—Cohen Pontani Lieberman & Pavane LLP

(57) ABSTRACT

A model toy aircraft is adapted for remote control operation on land, on the water and in the air. The toy aircraft includes a pair of pontoons spaced apart by a horizontal wing forming a tunnel hull. A tail section is provided including one or more moveable directional flight control surfaces. A motive mechanism is mounted directly or indirectly to the wing for propelling the aircraft.

52 Claims, 15 Drawing Sheets

MODEL TOY AIRCRAFT

RELATED APPLICATIONS

This application claims priority from U.S. Provisional Application Ser. No. 60/697,154, filed on Jul. 7, 2005, and is a Continuation-in-part of U.S. patent application Ser. No. 11/373,706, which was filed on Mar. 10, 2006. Both applications are hereby incorporated by reference in their entirety.

BACKGROUND

1. Field of the Invention

The present invention relates to the field of aeronautics and aircraft design, and provides a novel design particularly suited for model or toy aircraft.

2. Description of the Related Art

Model aircraft have been known for many years, and generally are designed to resemble full sized aircraft. That is, model aircraft have generally consisted of an elongate fuselage, with a central wing extending laterally out from the fuselage, and a tail assembly at the aft end of the fuselage. The tail assembly will generally consist of a vertical tail on which a vertical rudder is mounted, and short horizontal tail wings extending from either the aft end of the fuselage, or the top end of the tail. The elevators, controlling climb and decent angles, are mounted on the horizontal tail wings. Ailerons, controlling pitch and roll are mounted on the central wings, and are used, with the rudder, to steer the aircraft by rolling it while turning.

Alternatively, as shown in commonly assigned U.S. Pat. No. 6,612,893, steering may be accomplished by controlling the relative rates of revolution of each of a pair of wing-mounted engines.

It is known, moreover, to utilize electric motors to power the propellers or model aircraft, and this is shown in the aforementioned U.S. Pat. No. 6,612,893. Aircraft engines, for either full scale, or toy aircraft, may, depending on the overall design of the aircraft, be mounted in front of the main wing, on the wing, or behind the wing. In the former two configurations, the engine mount propellers known as tractor propellers, and in the later case, the propellers are known as pusher propellers. Propellers are generally mounted so as to be perpendicular to the longitudinal axis of the forward direction of flight. Lift is achieved by the flow of air over and under the wing surfaces. The wing surfaces are shaped so as to provide lift by creating downwash, an area of low pressure above the wing, and an area of high pressure below the wing, as the wing is moving through the air. If the speed of the aircraft through the air decreases below a critical velocity, the aircraft will loose lift and stall when the air pressure difference above and below the wings falls below a critical level. Stall will also occur in traditional designs, if the angle of attack of the wing, relative to the direction of flight, is increased beyond a critical point, usually about 15°.

It is also known to utilize surfaces other than wing surfaces, to generate lift. This can be accomplished by blending the fuselage into the central wings, thereby creating an all wing design, such as is exemplified by the well known B-2 bomber of the U.S. Air Force. Alternatively, a pair of pontoons or the like may be provided, with a flattened fuselage extending therebetween that can act like a wing. This design is shown in U.S. Pat. No. 5,273,238 to Sato, which teaches a twin-hull seaplane that also includes a traditional wing mounted above the fuselage. A wide flat fuselage and downwardly extending pontoons will assist in ground effect flight. Ground effect flight is a flight close to a ground or water surface, and uses the proximity of the surface to increase lift by decreasing the pressure above the wing, and increasing the air pressure below the wing. In order to transition from surface effect aided flight to ordinary flight, a large amount of thrust or downwardly vectored thrust is generally required.

The basic form of a hydroplane racing boat is well known. Generically, such a boat consists of a tunnel hull to which pontoons or sponsons are attached. The propulsive force is provided by a small submerged or semi-submerged propeller at the aft end of the tunnel hull centerbody. In high speed racing operation, the hull lifts up and hydroplanes on the sponsons. When this happens the hydrodynamic drag is dramatically reduced and relatively high speeds over water are possible. In this mode, the horizontal tail and supporting vertical fins or stabilizers provide some inherent static stability, which passively makes the boat more stable at high speed. For directional control a submerged rudder is used. Occasionally, hydroplanes crash in spectacular accidents after lifting completely off the water and losing all control. Hydroplane racing boats are not designed for controlled flight in air.

For high-speed flight on water, wing-in-ground effect vehicles (WIGs) and WIG ships sometimes called ekranoplans have been studied. These vehicles depend on lift from a wing to ride out of the water at high speed and skim the water's surface on sponsons or on a main centerline hull or fuselage. These concepts are not designed for operation on land or for flight out-of-ground effect. Moreover, WIGs cannot fly stationary in a hover.

The hovercraft or air-cushion vehicle (ACV) rides on an air cushion supplied by an enclosed plenum chamber that requires continuous contact with a smooth surface. Hovercraft cannot fly or hover.

For flight in air, there are two popular forms. The conventional aircraft configuration employing a wing with or without additional lifting surfaces, and the helicopter, generally and collectively called fixed-wing and rotary-wing aircraft. Although there are many flight vehicles that can be broadly classified as fixed-wing or rotary-wing aircraft, as well as other categories too numerous to mention, none of them appear similar to the basic forms of the model aircraft described herein, a hydroplane racing boat.

None of the above-mentioned vehicles resemble the model aircraft described by the applicants herein, which is a hydroplane racing boat with the ability to (1) skim the surface on land like a hovercraft, (2) hydroplane on water like a hydroplane racing boat, (3) take off and fly like a conventional fixed-wing aircraft and (4) stop in flight and hover like a helicopter. A vehicle capable of these modes of operation has been overlooked by prior innovators and is described by the applicants herein.

SUMMARY

The object of the applicants herein is to describe a model aircraft comprising novel features which may include providing a vehicle that can be maneuverable on water like a boat or hydroplane, that can be driven on land, and that can be flown like a stunt plane; including hovering flight.

Accordingly, there is provided a model toy aircraft comprising: a central wing having a front end, an aft end, a first side and a second side; at least two pontoons, each mounted to the first and second sides of the wing; a tail section including at least one moveable directional control surface, the tail section mounted on the aft end of the wing; a remote control operation system mounted to the wing; motive means connected to the remote control operation system and mounted directly or indirectly to the wing for propelling the aircraft, and a control surface control motor connected to the remote control operation system and to the at least one moveable directional control surface.

Other objects and features will become apparent from the following detailed description considered in conjunction with the accompanying drawings. It is to be understood, however, that the drawings are designed solely for purposes of illustration and not as a definition of the limits of the applicants' model toy aircraft, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION

Figure 12:
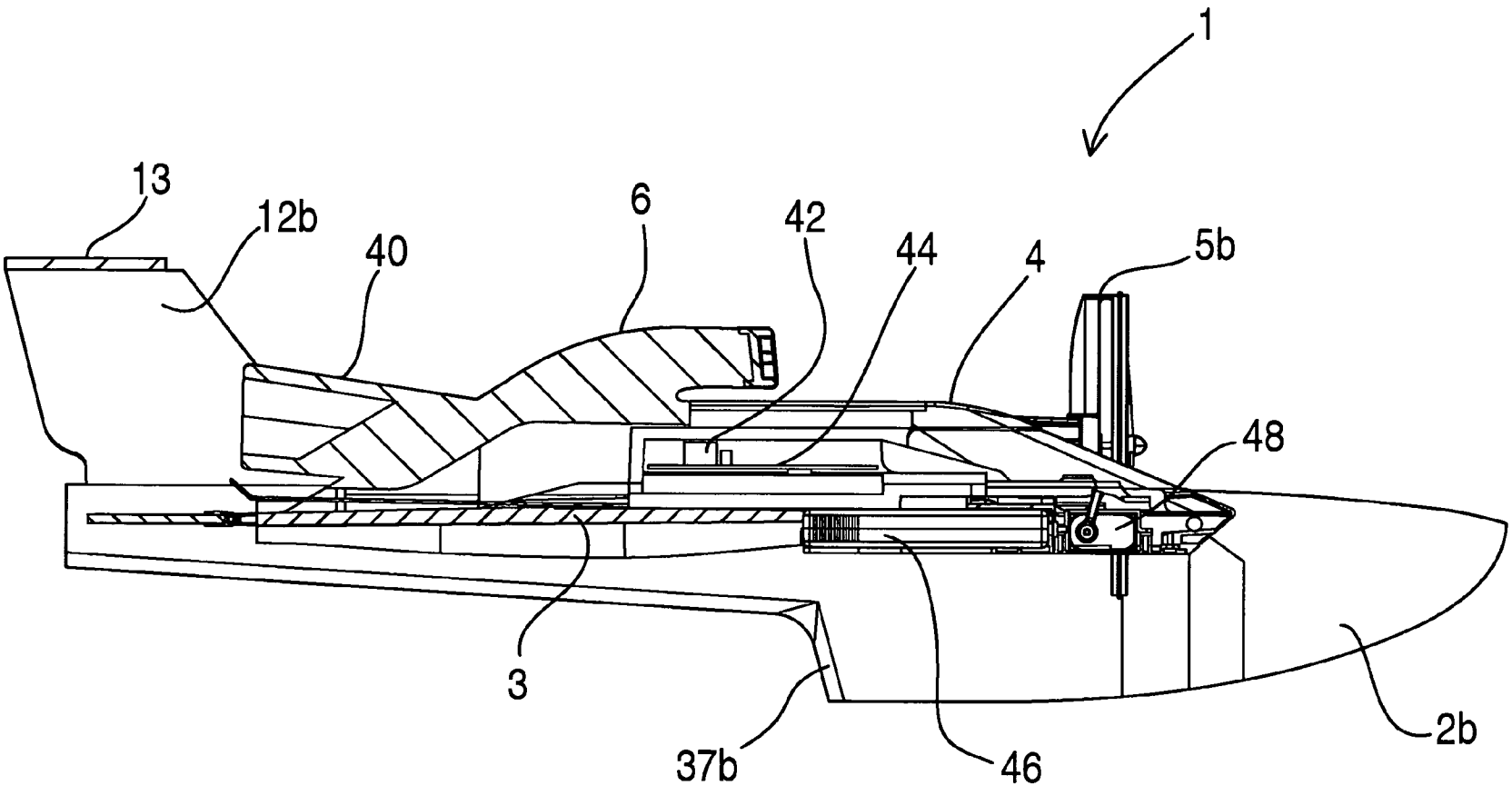
FIG. 12 is a sectional view of the embodiment of FIG. 1 taken along lines 12-12 of FIG. 5.

Referring now to FIGS. 1 to 6, the first embodiment of the model aircraft 1 includes a pair of pontoons 2*a* and 2*b* (also known as floats or sponsons) that are separated by a substantially flat central planar wing 3. A fuselage 4, a non-functional air scoop 6 and a non-functional exhaust 40 are mounted on the central section of the planar wing 3, substantially parallel to the pontoons 2*a* and 2*b*. As shown in FIG. 12, the fuselage houses system electronics, having a remote control operation system including radio receiver 42, a controller 44, and a power supply 46, an engine (not shown), and a flight surfaces control motor or motors 48.

One embodiment of the model aircraft 1, as shown in FIGS. 1-6, has two propellers 5*a* and 5*b* mounted on the front edge of the central planar wing 3 by means of propeller housings 10*a* and 10*b*. The two propellers enable the use of differential thrust to turn the aircraft by driving one propeller faster than the other, rather than using a rudder. Additionally, the sweep diameter of each propeller extends almost the entire width between the pontoons and the fuselage. This relatively large width enables an efficient operation in air. A strengthening rod 36, for instance a 2 mm rod, extends through the foremost portion of the fuselage 4 in front of the two propellers 5*a* and 5*b*, and is also attached to the upper region of the internal surfaces of the pontoons 2*a*, 2*b*.

Figure 1:
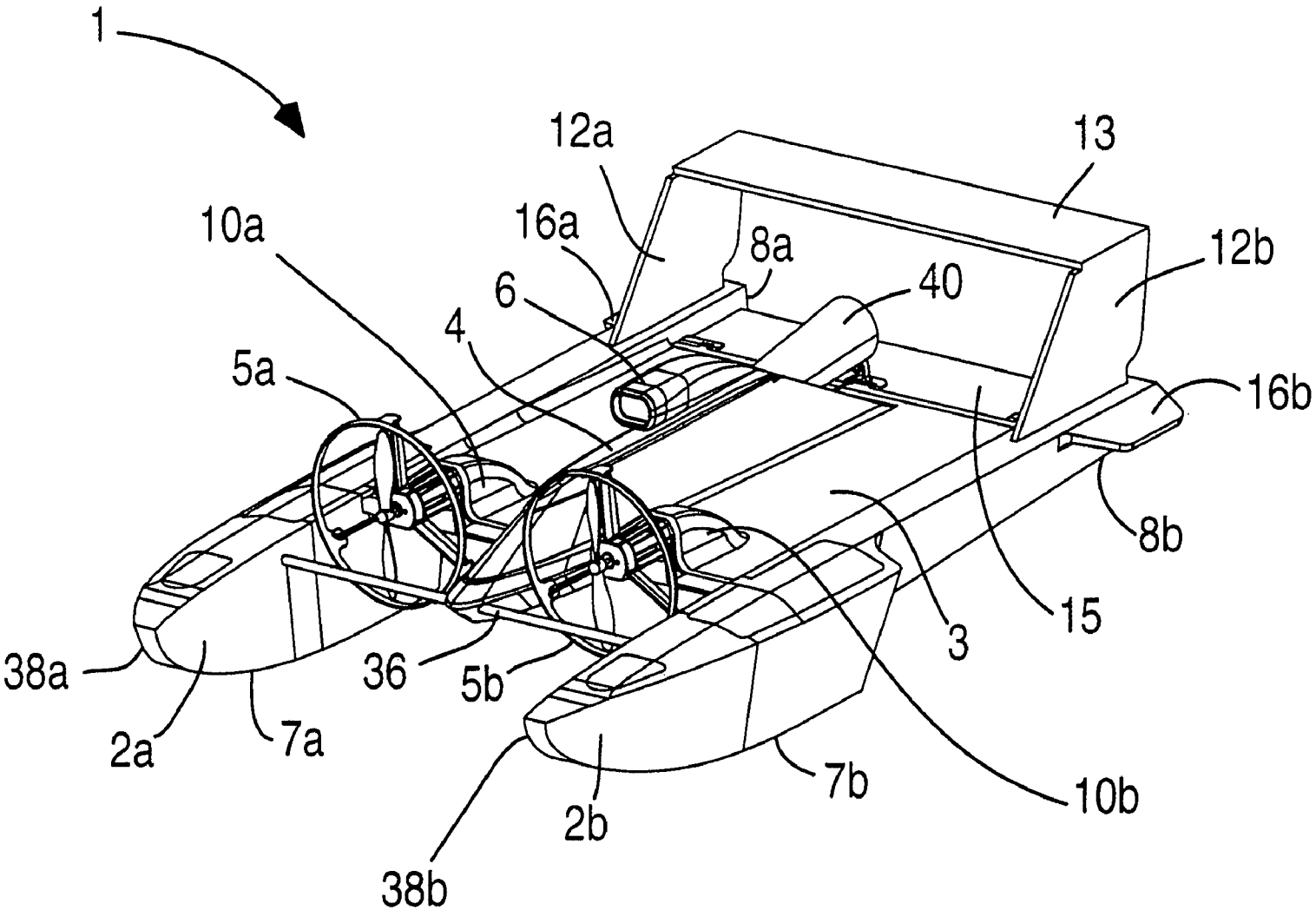
FIG. 1 is a left perspective view of a first embodiment of the applicants' model toy aircraft.
Figures 5, 6:
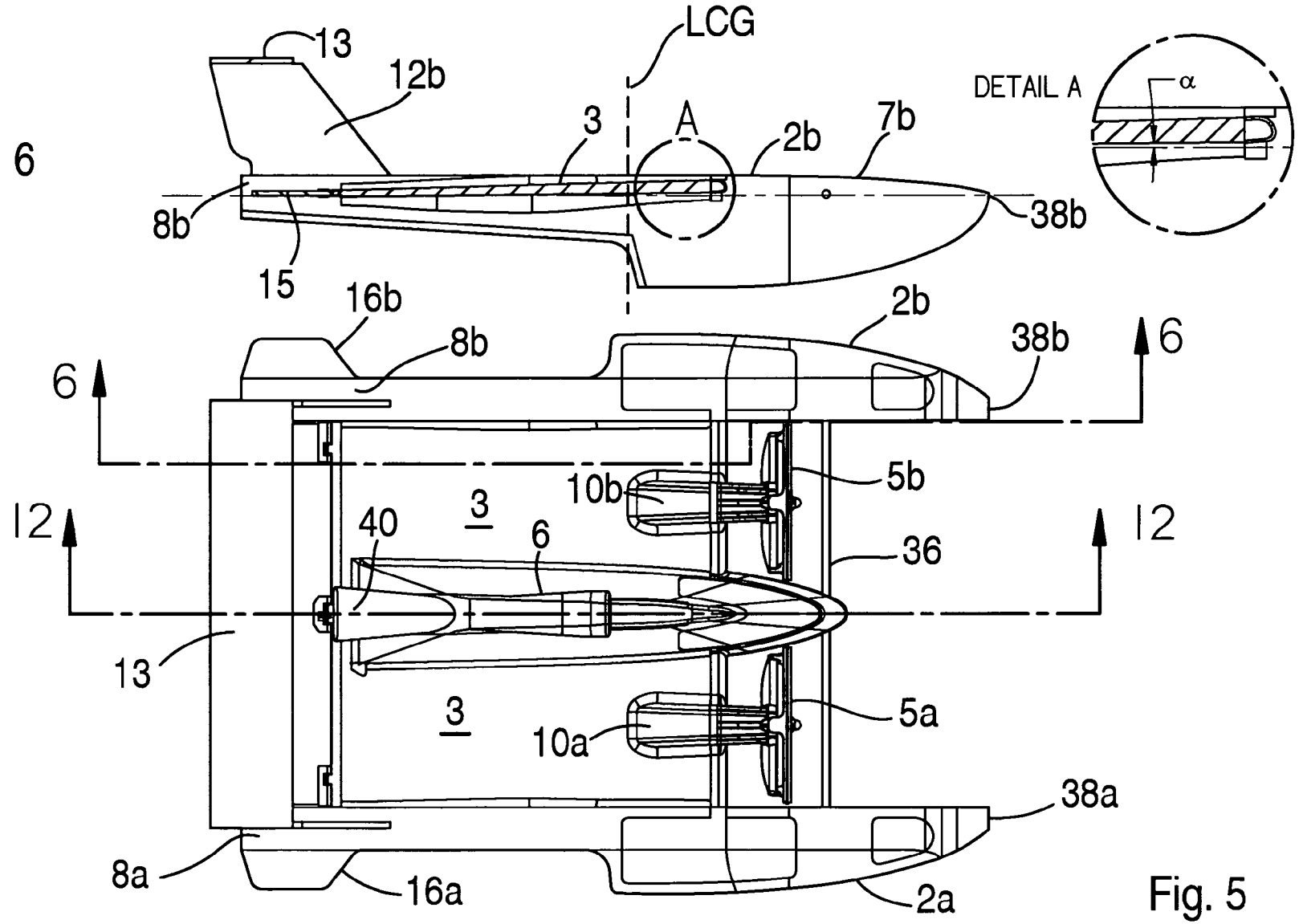
FIG. 5 is top plan view of the embodiment of FIG. 1.
FIG. 6 is a sectional view of the embodiment of FIG. 1, taken along lines 6-6 of FIG. 5.

The pontoons provide floatation to the model aircraft and also provide a bottom surface enabling the model aircraft to skim the water in hydroplaning mode and keep the aircraft balanced during flight. As seen in FIG. 1, the front portions 7*a* and 7*b* of the pontoons are enlarged in relation to the rear portions 8*a* and 8*b*, and in relation to the central planar wing 3. Each front portion tapers upwardly and inwardly towards the pontoon noses 38*a* and 38*b*. The taper of the front portion of each pontoon is inwardly convex toward the nose of each pontoon and the lower surface curves upwardly in a shallow convex curve toward the nose of each pontoon. This assists in keeping the front portion from digging in at high speed on water during a turn. Moreover, as shown in FIGS. 1, 3 and 6, each pontoon tapers from front to rear.

Figure 2:
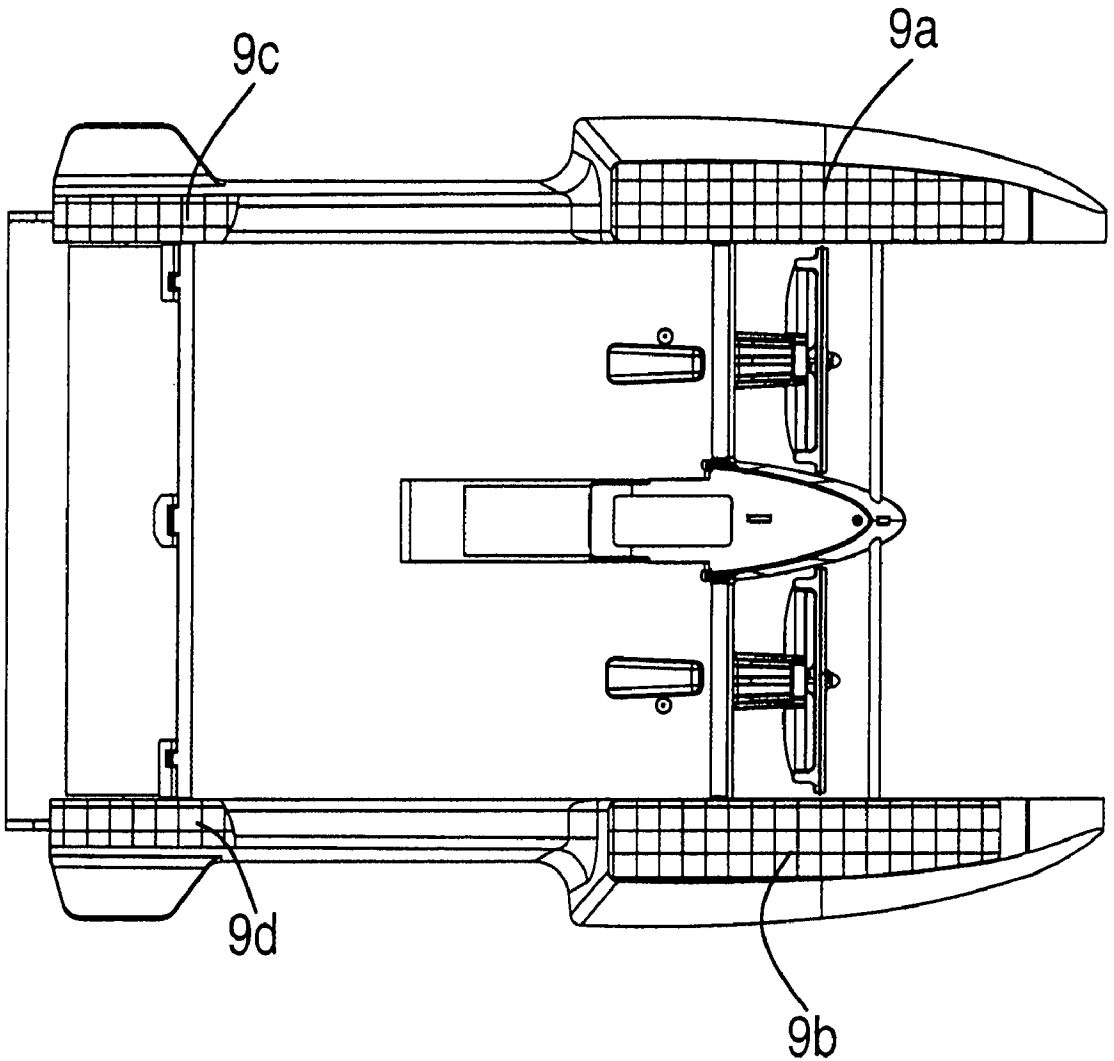
FIG. 2 is a bottom plan view of the embodiment of FIG. 1.

Each of the lower surfaces of the forward end and aft ends of the pontoons are provided with a low friction, hardened, scuff and tear resistant coating 9*a*, 9*b*, 9*c* and 9*d* (see FIG. 2). The resistant coating material is preferably fiberglass, plastic or wood. The remainder of the model aircraft can be made from any lightweight sheet material capable of being formed and being resilient enough to maintain rigidity, such as, but not limited to, foamed polystyrene.

Figure 3:
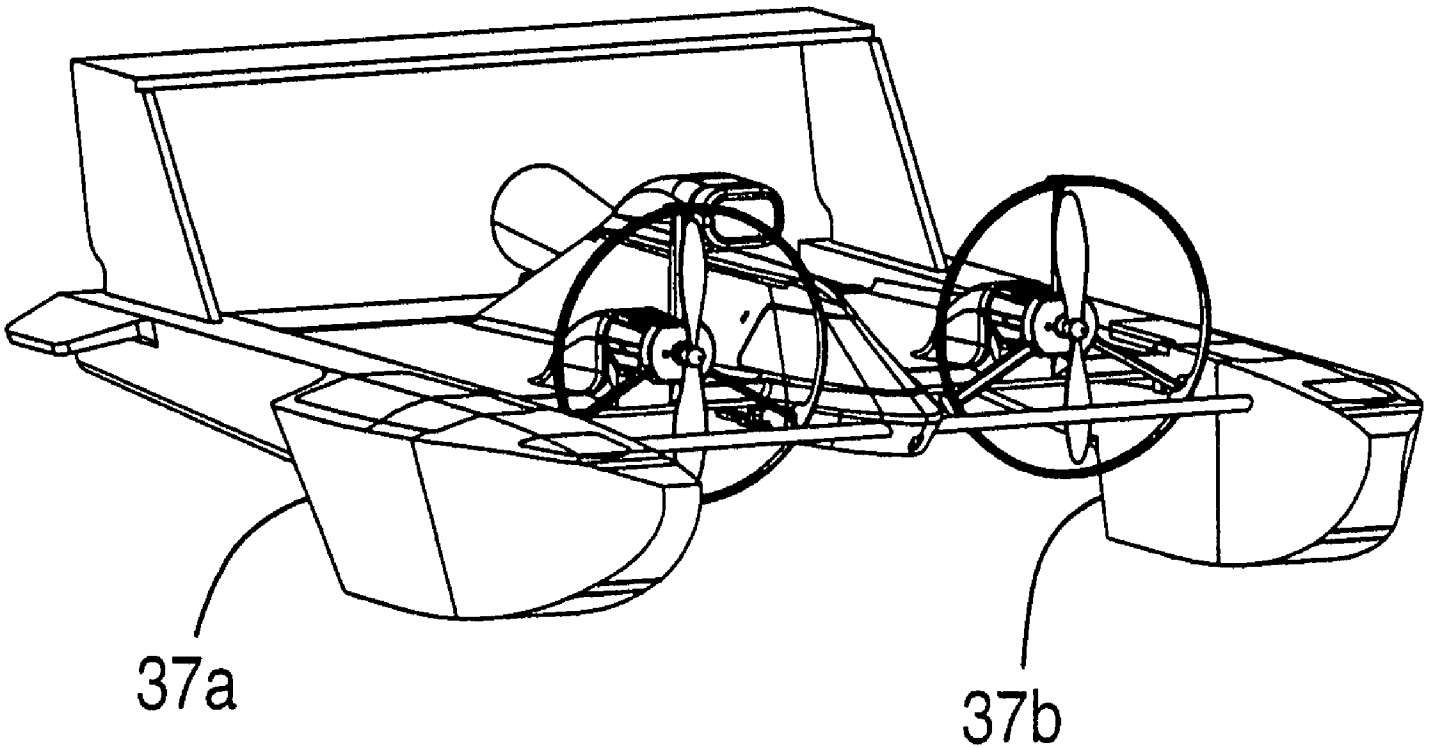
FIG. 3 is a right perspective view of the embodiment of FIG. 1.

The lower surface of the pontoons include steps 37*a* and 37*b* at about a third of the length from the front portion to the rear portion as seen in FIG. 3. This step, which is optional, improves performance of the model aircraft on the water. When moving on the water the aircraft will rise up onto the front portions 7*a* and 7*b* of the pontoons and start to hydroplane, greatly reducing drag on the pontoon by the water, and thereby permitting the model aircraft of the present invention to achieve higher speeds and turn more easily.

Figure 4:
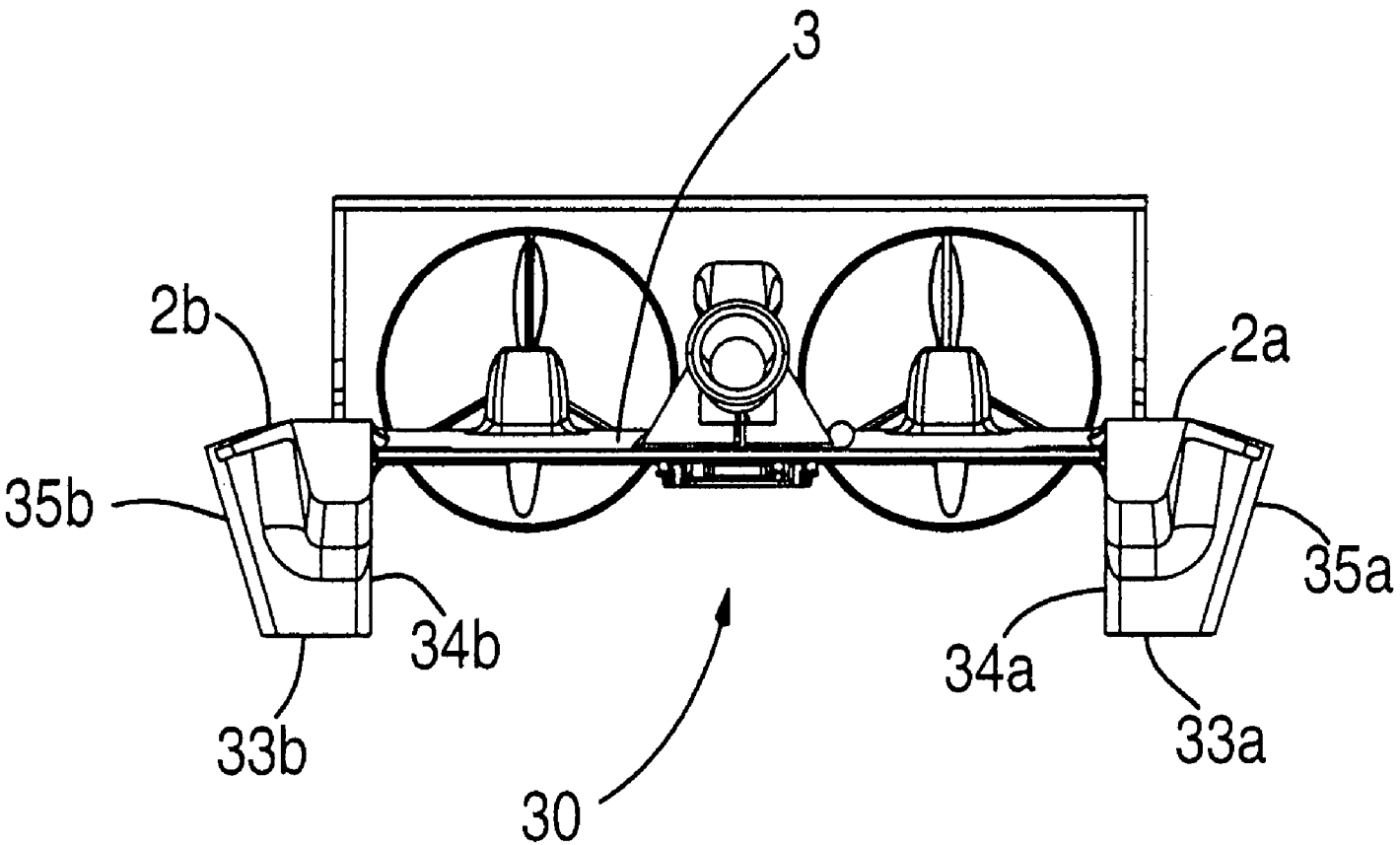
FIG. 4 is a rear view of the of the embodiment of FIG. 1.

The central wing 3 together with the outboard pontoons 2*a* and 2*b* define a tunnel hull 30 as seen in FIG. 4. The central wing 3 is made up of a thin, stiff panel which may be flat, as shown in FIG. 6, or the wing 3 may be essentially a flying wing in the shape of a reflexed airfoil. In this configuration, a longitudinal cross-section of the wing 3 would show a generally concave to convex shaped airfoil, commonly known as a reflexed airfoil. Such an airfoil is typically used on flying wing aircraft designs to provide for pitch stability. In the model toy aircraft described herein, the addition of the pontoons has the beneficial effect of increasing the effective aerodynamic span of the center wing 3 when used in the current hydroplane configuration. The use of the thin airfoil on the aircraft is essential to provide low aerodynamic drag for flight in air.

As shown in FIG. 6, the central wing 3 of the model aircraft is angled slightly upward from the horizontal and exhibits an angle of attack $\alpha$ on a horizontal movement forward of between about 5°to about 10°, preferably about 7°, which provides sufficient lift, without approaching the stall angle of 15°.

Each pontoon at its rear portion terminates in vertical stabilizers 12*a* and 12*b* extending upwardly therefrom, as shown in FIG. 1. The vertical stabilizers 12*a* and 12*b* may or may not be spanned at their upper ends by a horizontal stabilizer 13 attached adjacent to the upper portions of the vertical stabilizers. This oversized horizontal tail surface spans the width of the craft and has a longitudinal chord length of at least 20% of its span. This surface functions to produce additional static and dynamic stability in pitch for flight in air. Also, out-rigger sub-tail flying surfaces 16*a* and 16*b* may be mounted on the aft ends of the pontoons. These surfaces further enhance the pitch stability of the aircraft for flight in air.

A moveable lower elevator control surface 15 parallel to the horizontal stabilizer 13 is located at the aft end of the center planar wing 3. This movable control surface is used for pitch control of the aircraft.

Figure 7:
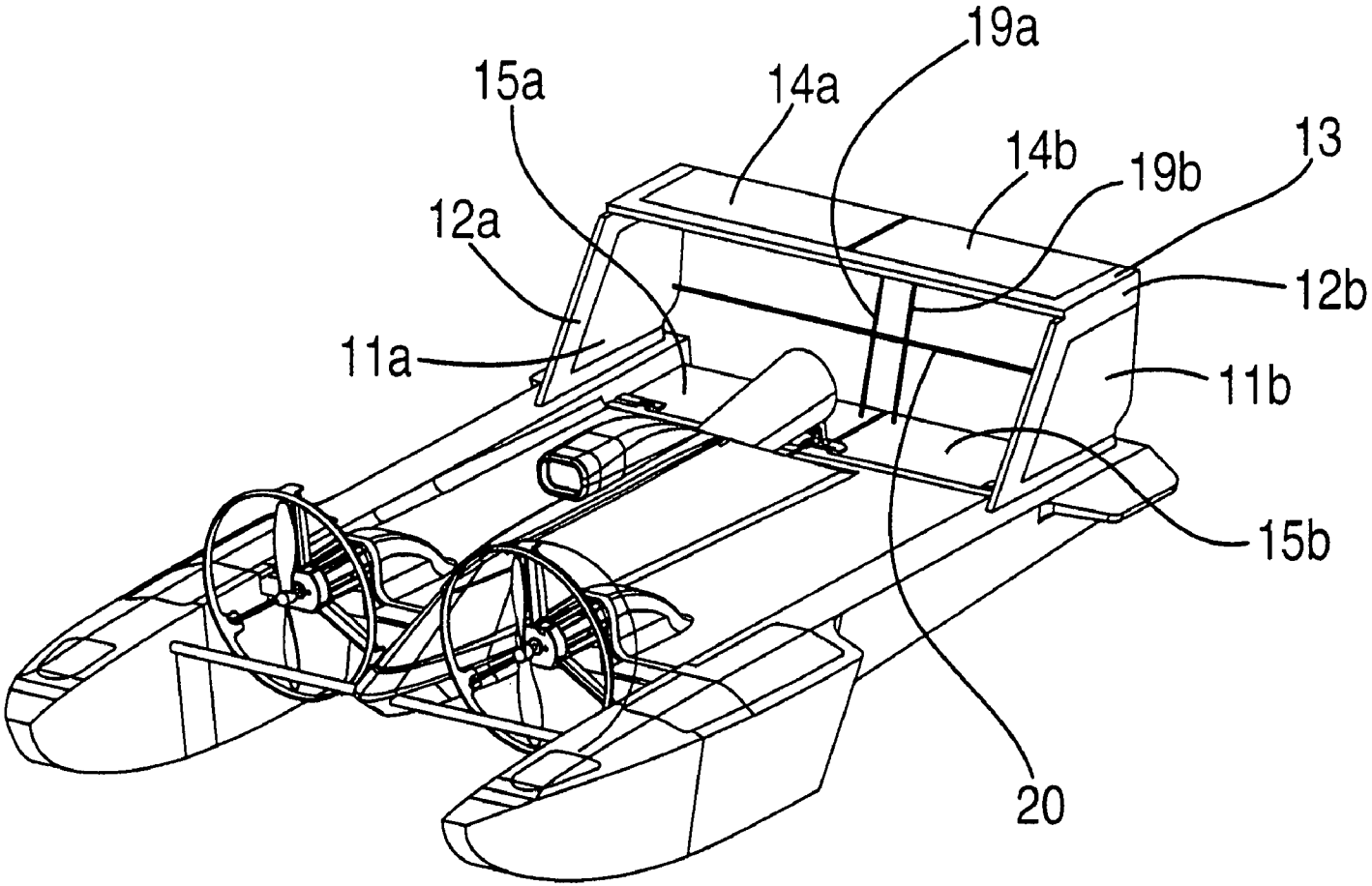
FIG. 7 is a is a left perspective view of a second embodiment of the applicants' model toy aircraft.

Optionally, in another embodiment of the invention shown in FIG. 7, it is possible to split the movable control surface 15 at the center to provide independent control of the right 15*a* and left 15*b* halves. In this configuration, differential movement of the right and left halves of the control surfaces can provide for roll control of the aircraft and can be used to counter the torque of the propellers when they rotate in the same direction when the aircraft is pointed vertically up in hover flight.

As seen in FIG. 7, the vertical stabilizers 12*a* and 12*b* may each include a rudder 11*a* and 11*b*, the two rudders linked by connector 20 to move parallel to one another at all times. Horizontal stabilizer 13 may have a split upper elevator control surface having a left elevator control surface half 14*b* and a right elevator control surface half 14*a*. As noted above, the lower elevator control surface 15, which extends from the aft edge of the main planar wing, may also have a left elevator control surface half 15*b* and a right elevator control surface half 15*a*. Each of the right and left halves of the upper and lower elevators are linked to one another by connectors 19*a* and 19*b*, respectively. The left and right, upper and lower, elevators 14*a*-15*a* and 14*b*-15*b* may be operated right and left halves together, in the manner of conventional elevators, to lift or dive. Alternatively, the right and left elevators may also be operated in the manner of ailerons, to control roll of the aircraft.

In the embodiment of the model aircraft having two propellers 5*a* and 5*b* shown in FIGS. 1 to 7, the aircraft operator uses a remote control transmitter unit (not shown) to provide control commands to remote control operation system (shown in part as receiver 42, controller 44, and power supply 46 in FIG. 12) housed in the front region of the fuselage 4, for operation of the moveable elevator control surface 15, for the embodiment of FIGS. 1-6, or moveable elevator control surfaces 14*a*, 14*b* and 15*a*, 15*b* for the embodiment of FIG. 7. The commands also control total thrust, and differential thrust of propellers 5*a* and 5*b*. Commands for pitch, total thrust and differential thrust are sent to an onboard microprocessor (not shown) of the remote control operation system, which controls servomotors or other motive means 48 connected to the control surfaces, and also sets the thrust of the two propellers. Commanding an increase in the total thrust increases the speed of both propellers equally increasing the aircraft speed. On the other hand, a differential thrust command increases the speed of one propeller more than the other causing the aircraft to turn. Thus, to an operator of the model aircraft, the commands are in effect: (1) thrust, by commanding total thrust; (2) turning, by commanding differential thrust; and (3) pitch by commanding the up or down movements to the elevators.

The aircraft is preferably powered by electricity and has preferably only one servomotor 48 (see FIG. 12), housed in the fuselage 4, to actuate the movable control surface or surfaces. However, it can be equipped with a second servomotor if a rudder control is desired. This additional rudder control would allow the operator to more easily roll the craft in the air.

Figure 8:
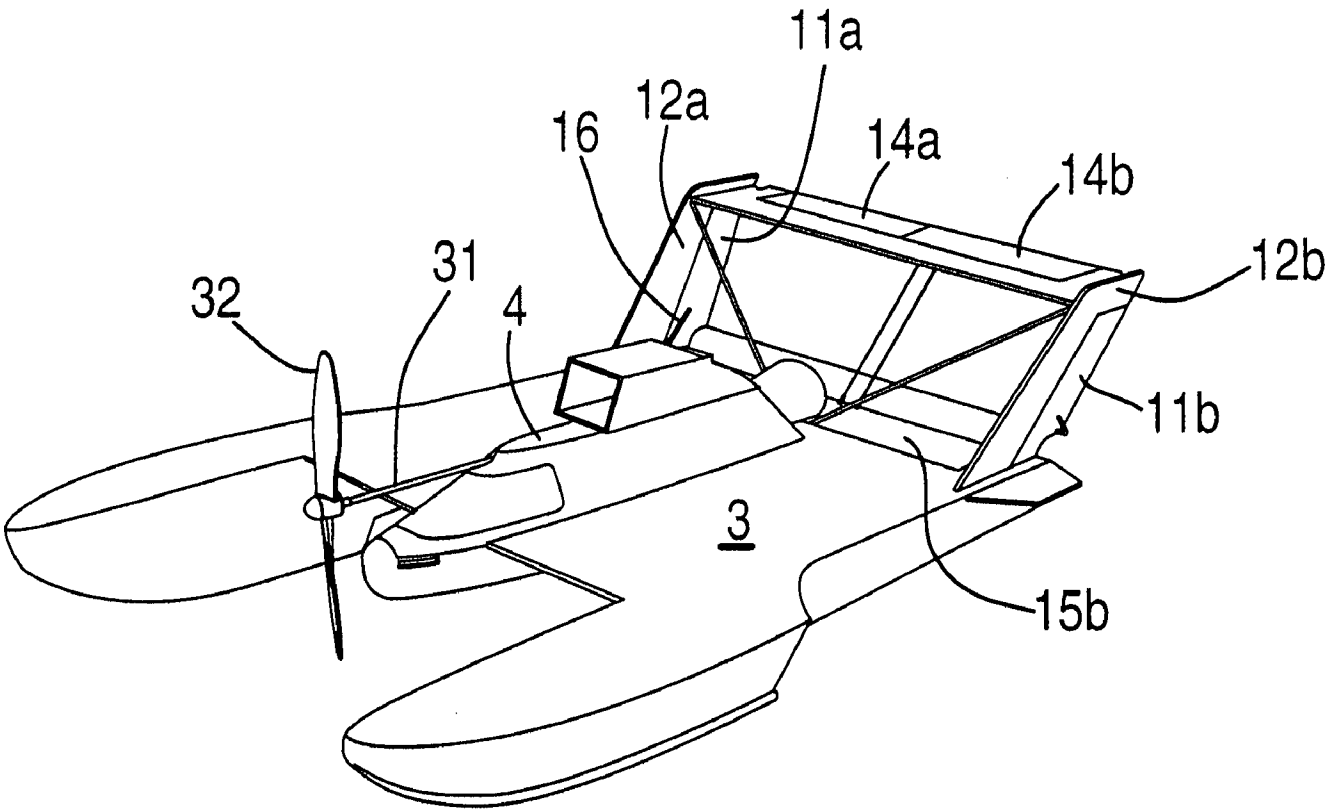
FIG. 8 is a is a left perspective view of a third embodiment of the applicants' model toy aircraft.
Figure 9:
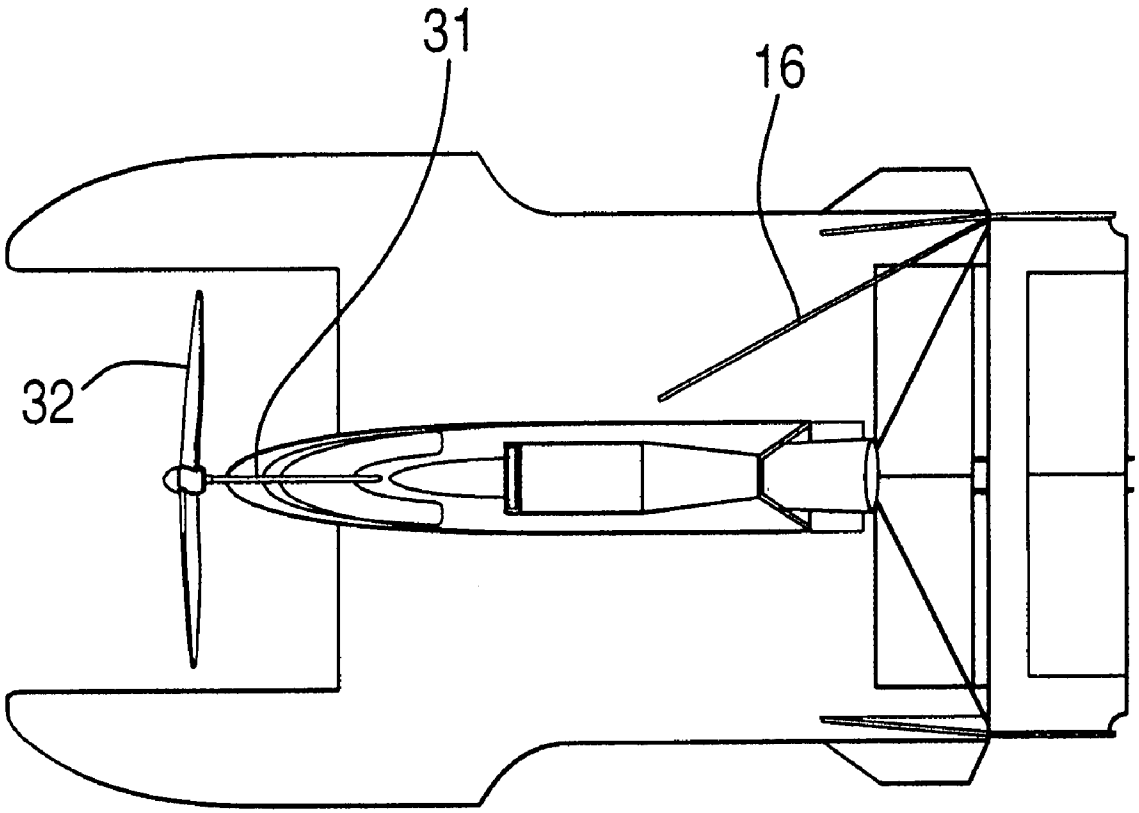
FIG. 9 is a top plan view of the third embodiment of FIG. 8.
Figure 10:
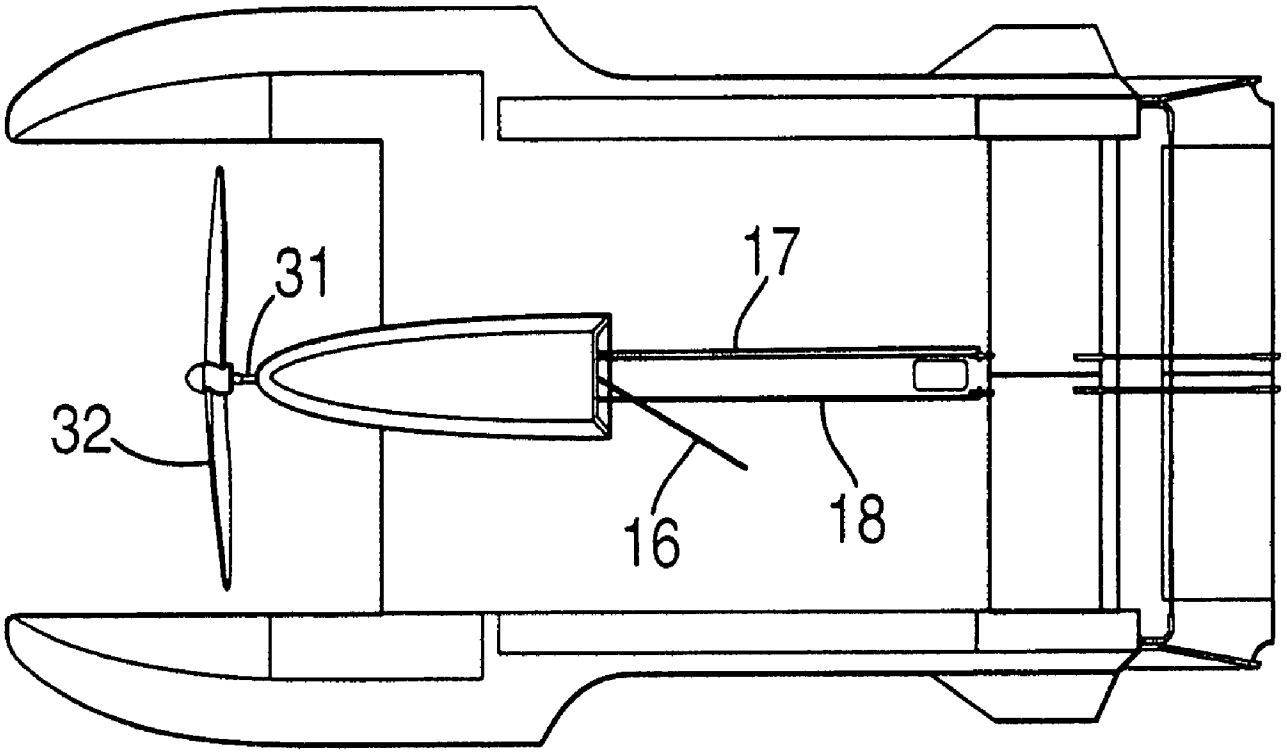
FIG. 10 is a bottom plan view of the third embodiment of FIG. 8.

In another embodiment of this invention, shown in FIGS. 8-10, there is included a hollow propeller shaft tube 31 extending forwardly from the fuselage 4, defining a propeller shaft housing, and a tractor propeller 32 mounted forward of the wing 3, driven by a motor (not shown), also housed in the fuselage. The motor may be an electric or internal combustion engine, preferably electric to facilitate remote speed control of the motor. A rechargeable battery (not shown) is provided in the fuselage as well. The battery powers the electric motor (not shown), system electronics (not shown), remote control operation system (not shown), a control circuit (not shown), and flight surfaces control motor or motors (not shown) such as a conventional servomotor. The flight surfaces control motor or motors control the movable control surfaces at the aft end of the model aircraft. Linkages between the flight surfaces control motor or motors and the flight control surfaces (vertical stabilizers 12*a* and 12*b*, rudders 11*a* and 11*b*, split upper elevator control surface halves 14*a* and 14*b* and split lower elevator control surface halves 15*a* and 15*b*) can be either solid rods, or flexible lines, shown as 16, 17 and 18 in FIGS. 9 and 10, and are substantially conventional.

Figure 11:
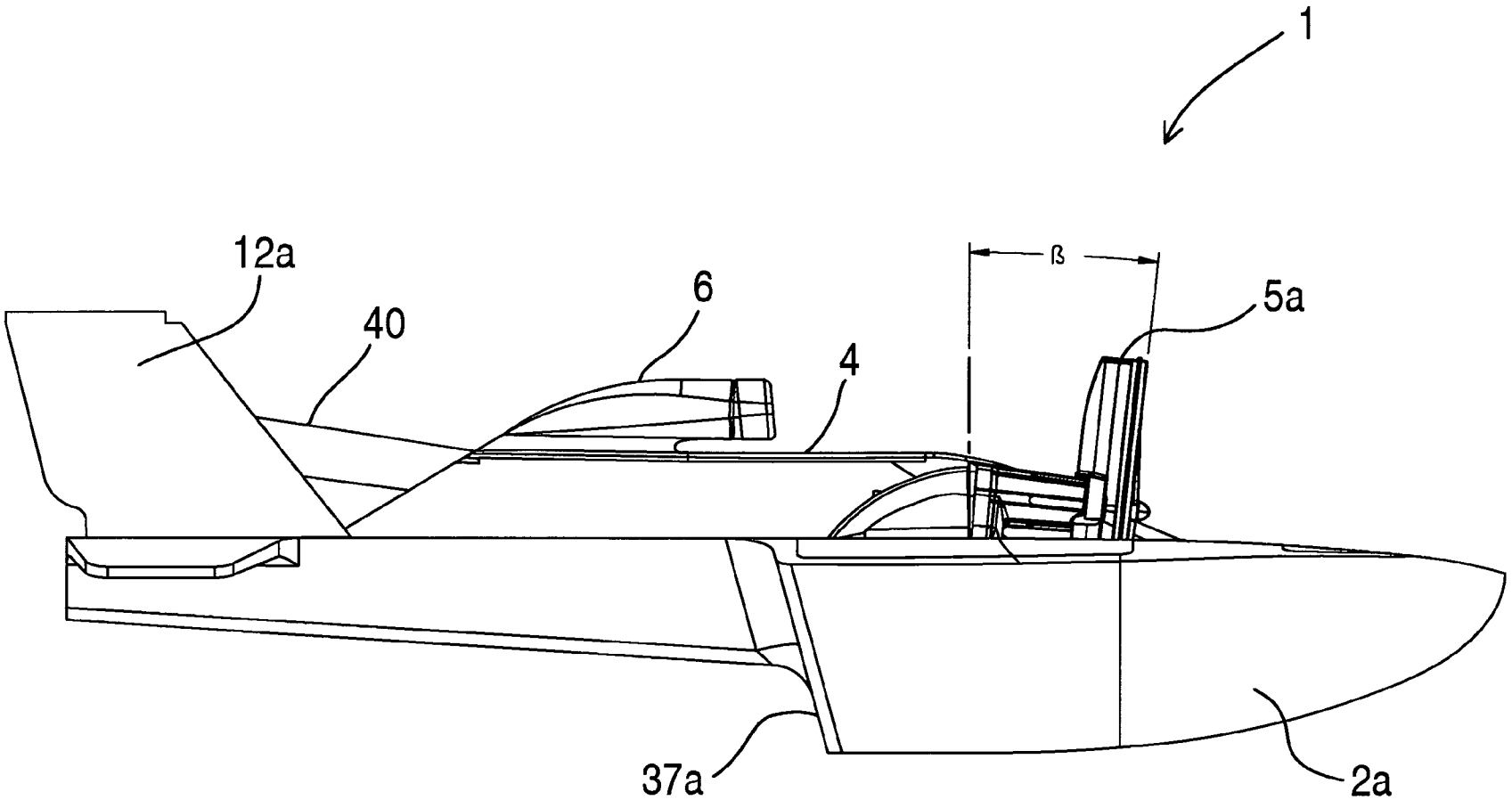
FIG. 11 is a right side view of the embodiment of FIG. 1, showing the propellers angled downward.

Optionally, the tractor propeller 31 or propellers 5*a*, 5*b*, as shown in FIG. 11, are set at a downward angle β of between about 1° to about 8° relative to wing incidence, to provide a down force to counter the lift created by the angle of attack of the planar wing 3. This permits the aircraft to operate on water or on the ground without use of the control surfaces, which might otherwise result in pitching the aircraft over on its nose.

Figure 13:
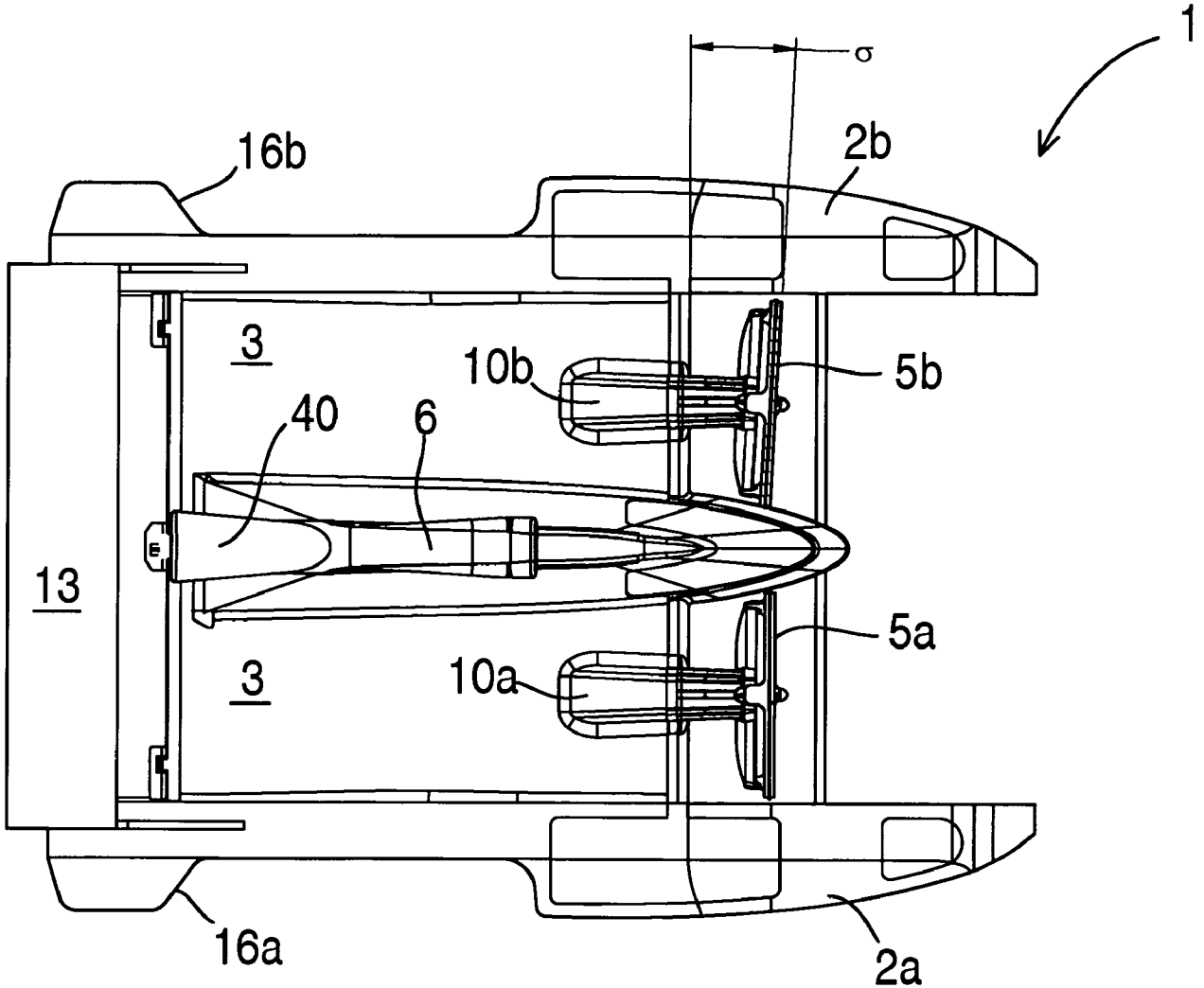
FIG. 13 is a top plan view of the embodiment of FIG. 1, showing the left-side propeller angled slightly inward.

Rotational forces created by propellers 5*a*, 5*b* tend to cause the craft to make a constant left turn and make it difficult to turn the craft to the right. To solve this problem, the applicant has found that the left-side propeller 5*b* can be angled slightly inward, towards the right (right thrust), as sown in FIG. 13. In the present embodiment the applicant has used an inward angle σ of about 3°, however, those skilled in the art will understand that an angle of more or less than 3° might be necessary to counter the rotational forces of the propellers so that the craft will fly and turn correctly.

The model aircraft can also be driven on the ground, using ground-effect to reduce frictional drag so that the propeller or propellers can provide motion while the model aircraft is in contact with the ground. Operating in ground-effect also lifts the pontoons out of the water or off the ground reducing drag. Operating the moveable control surfaces allows the model aircraft to achieve high speeds while remaining in contact with the ground or water by increasing down forces, and preventing the front part of the model aircraft from lifting. In the model toy aircraft as described herein, the operator is able to lift the front part of the fuselage and cause the aircraft to transition from floating mode (boat) or ground mode (landspeeder) to air or flight mode. Once airborne, the movable control surfaces allow the aircraft to stabilize in forward flight, enabling the operator to make controlled turns and to perform aerobatic maneuvers. An additional rudder (not shown), under the main wing, may also be provided to assist in steering on water.

Figure 15:
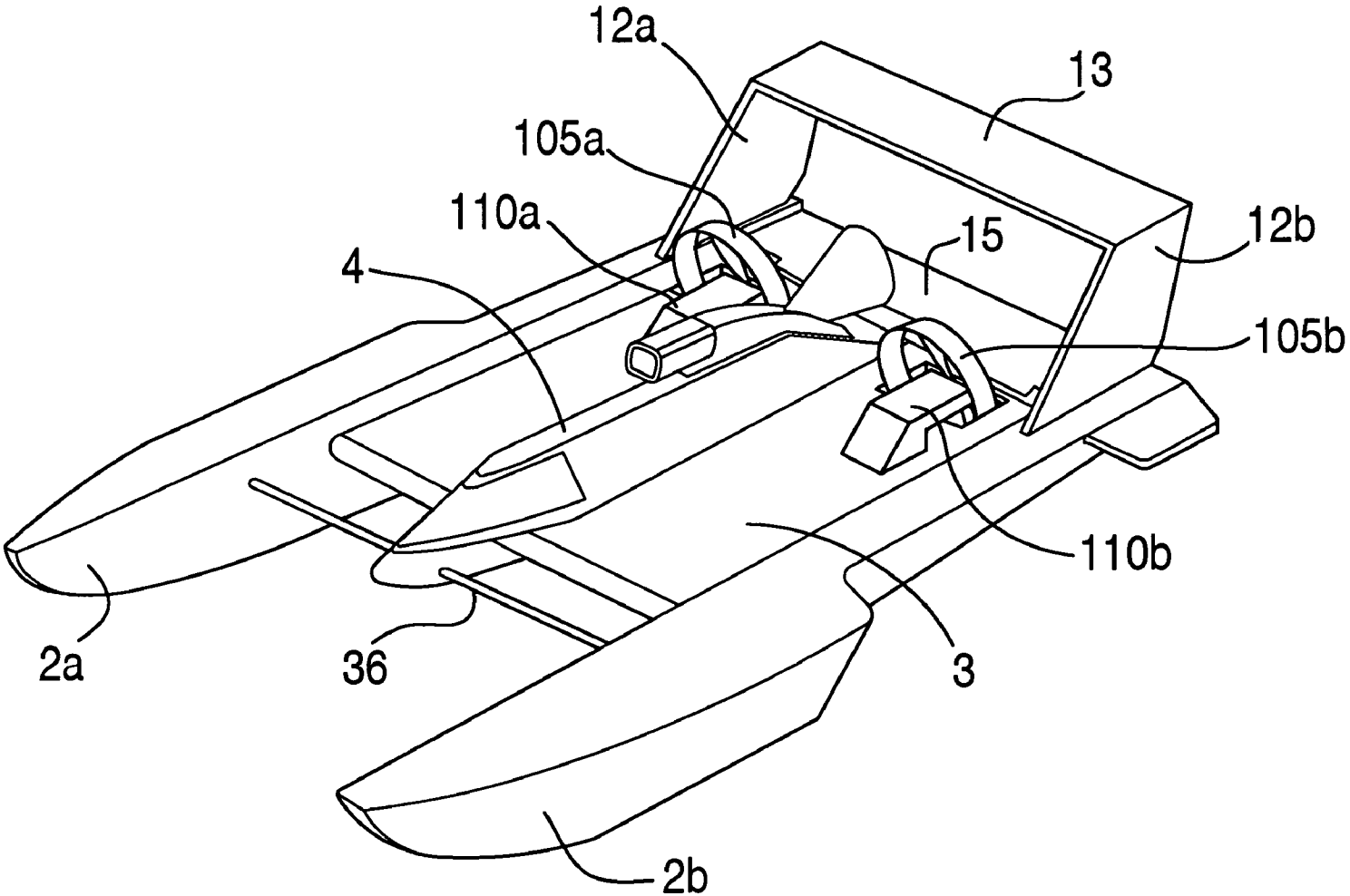
FIGS. 15 and 16 are left side perspective views of further embodiments of the model toy aircraft with the propellers mounted at the rear of the aircraft.
Figure 16:
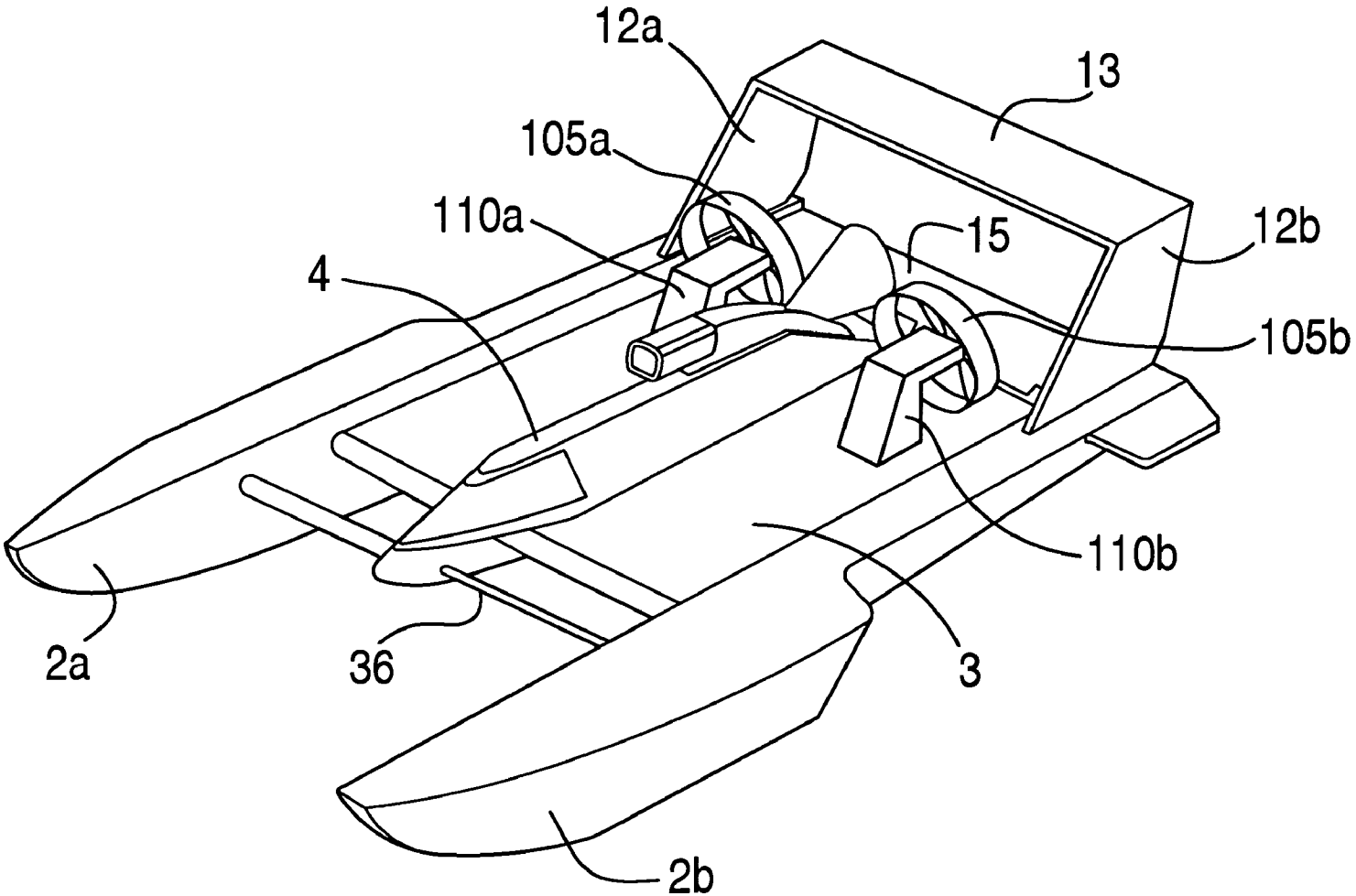

It will be understood that while the model aircraft as provided herein has been described including a single or double tractor propeller, it is also feasible to power the model aircraft with more than two tractor propellers. As shown in FIGS. 15 and 16, it is also feasible to power the model aircraft with one, two or more pusher propellers, such as pusher propellers 105*a* and 105*b*, mounted at the rear of the aircraft, for instance on pylons or struts 110*a* and 110*b* extending upwardly from the rear portion of the horizontal wing 3.

The remote control operation system (shown in part as receiver 42, controller 44, and power supply 46 in FIG. 12), housed in the front cockpit region of the fuselage 4 provides proper mass balance to the aircraft for flight operation in air. The longitudinal center of gravity "LCG" of the aircraft as shown in FIG. 6, measured from the front along the airfoil of the wing 3, is substantially at the 25% region.

One of the features of the present invention is the geometry of the central region of the aircraft, where the flat central planar wing 3, fuselage 4, air scoop 6 and exhaust 40 are located. The front part of the central region is streamlined in shape and only large enough to house part of the electronics. The aft part of the central region (including vertical stabilizers 12*a* and 12*b*, spanned by the horizontal stabilizer 13 and the moveable control surface 15) is bulky and adds considerable drag. Since this bulky region, starting from the air scoop aft, is located behind the 25% region of the wing, the high drag acting on this part of the central region provides for additional aerodynamic stability in pitch.

For surface skimming on land or water, the operator commands to the aircraft include thrust and turning. The elevator control surface 15 or surfaces 15*a*, 15*b*, 14*a*, 14*b* in the embodiment shown in FIG. 7, is/are then actuated to pitch the aircraft up, which at a sufficient speed will cause the aircraft to pitch up out of ground effect and fly like an airplane. Beyond this stage, additional pitch commands will cause the airplane to pitch up vertically into a hovering attitude that can be sustained by coordinating all three primary controls.

When in operation on land and water the model aircraft uses ram air effects together with the lifting properties of the flat central planar wing 3. In order to be able to use the ram air effect in combination with the properties of the wing, the design of the present aircraft provides an appropriate positive incidence angle on the wing relative to the ground. As described above, the aircraft provides an angle of attack of between about 5° and about 10°, preferably about 7°, providing sufficient lift, without approaching the stall angle of about 15°. High thrust is necessary to lift up and accelerate the aircraft, at which point less thrust is needed to sustain cruising speed since the aircraft has lifted off the ground slightly and reduced its own ground contact drag.

Directional stability is provided by the aft mounted vertical stabilizers 12*a* and 12*b* together with the larger pontoon surface drag area aft of the aircraft longitudinal center of gravity. Directional control involves a complex interplay of aerodynamics, ground friction and vectored thrust. For a left turn command, the right propeller speed is increased by the onboard microprocessor. Higher thrust on the right side yaws the vehicle to the left. This command alone is not sufficient to turn the aircraft effectively. The shape of the pontoons plays a key role to effectively and correctly turn the aircraft. With the aircraft in a left yaw, the right pontoon generates less drag from both the aerodynamics and ground contact drag as compared with the left pontoon. Since the left pontoon has higher drag, the vehicle yaws an additional amount to the left. The yaw from the propellers combined with the yaw produced by the pontoons is enough to point the aircraft and hence the thrust in the direction of the turn. At this point, the effect of differential thrust-vectoring causes the vehicle to turn. An additional contribution is generated by the lifting force of the center flat planar wing 3. Since the right pontoon is angled on the outboard side, the right side in the above-described maneuver, the aircraft tends to roll left when in a left yaw. This left roll causes the lift vector to tilt in the direction of the desired turn, and consequently the lift vector produces a force component in the direction of the turn.

For flight in air, stability and control in roll, pitch and yaw must be established, while only yaw must be stable when in ground effect. Like many aircraft, the model toy aircraft described herein will have a slow spiral divergence, which can be adequately controlled by the operator. In pitch, the aircraft has a positive static margin by way of using a substantially central flat planar wing 3, which may be in the shape of a reflexed airfoil, augmented with the additional horizontal tail surfaces, such as stabilizer 13 (optional) and lower elevator control surface 15, and appropriate placement of the longitudinal center of gravity. Yaw stability is achieved by the aft mounted vertical stabilizers 12*a* and 12*b*, and greater pontoon side area aft of the longitudinal center of gravity. Pitch control is achieved using the elevator control surfaces. Turning commands from the operator provide differential thrust, which yaws the aircraft. The shape of the pontoons leads to roll coupling with yaw, and turns the aircraft via the "dihedral effect". In this case, when the vehicle is in a left yaw for a left turn, the right pontoon projects a forward inclined surface to the oncoming airstream. This generates an upward force on the right side of the vehicle. The pontoons have a sharp lower edge 33*a* and 33*b* (sharper than the top) as it can be seen on FIG. 4, causing a greater acceleration of the air flow around the lower edge of the pontoon, which leads to lower pressure and hence less lift on the left pontoon. As in ground effect, the differential in the drag of the pontoons also causes an additional yaw contribution, and consequently a greater difference in lift between the right and left pontoons.

This lift differential causes the aircraft to roll left, which tilts the lift vector and thereby turns the vehicle to the left as desired with left turning commanded input. The success of this maneuver obviously is quite dependent on the shape of the pontoons. It is preferable that the pontoons have flat faces 34*a* and 34*b* on the inner side and beveled or tapered faces 35*a* and 35*b* on the outer side. Each pontoon extends substantially from the front end to the aft end of the wing, and has a substantially planar and vertical inner face and an outer face inwardly inclined from top to bottom. Each pontoon has a flat upper surface and a mostly flat lower surface, the outer face extending from the upper to the lower surface. As shown in FIGS. 1, 3 and 6, each pontoon tapers from front to rear.

An additional consideration is pitch sensitivity in cruise flight. In cruise flight, the otherwise non-functional air scoop 6 takes on an important function. It provides an area of high drag above the vertical center of gravity. The resulting moment cancels the moment produced by the high drag on the pontoons, which are below the vertical center of gravity. The optional aft high-mounted horizontal stabilizer 13 and the elevator control surface 15 also aid to balance the pitching moment in cruise flight.

Figure 14:
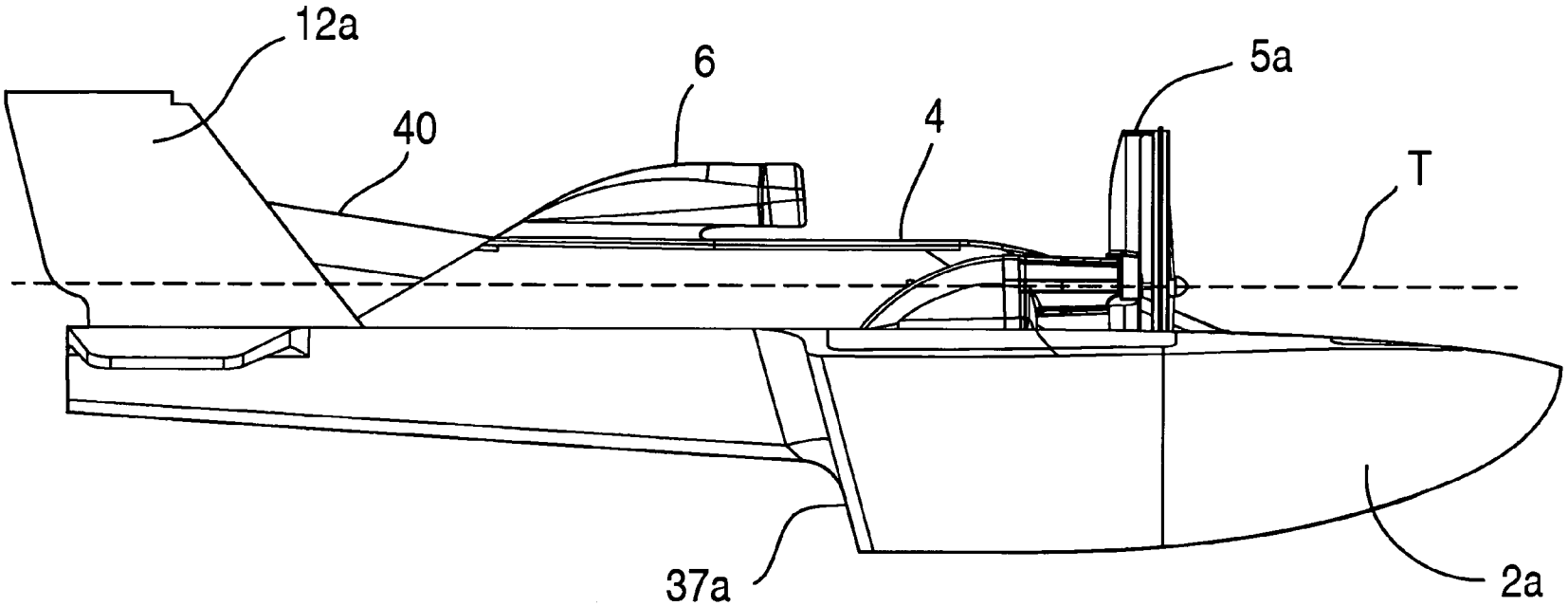
FIG. 14 is a right side view of the embodiment of FIG. 1, showing the propeller thrust line.

To achieve hovering flight and a vertical climb depends first on having a high thrust-to-weight ratio. Successful and controllable hovering is achieved when the thrust-to-weight ratio is near two. Highly efficient micro-motors (not shown) and high power batteries 46 (see FIG. 12) in a lightweight form are provided. Moreover the entire structure of the aircraft is preferably very light, which is preferably achieved using advanced foam materials. To better control hover, the propeller thrust line "T", as shown in FIG. 14, is coincident with the vertical center of gravity of the aircraft and the zero lift line of the airframe.

Thus, while there have been shown and described and pointed out fundamental novel features of the model toy aircraft as described herein, it will be understood that various omissions and substitutions and changes in the form and details of the devices illustrated, and in their operation, may be made by those skilled in the art without departing from the spirit of the invention. For example, it is expressly intended that all combinations of those elements and/or method steps, which perform substantially the same function in substantially the same way to achieve the same results, be within the scope of the invention. Moreover, it should be recognized that structures and/or elements and/or method steps shown and/or described in connection with any disclosed form or embodiment of the model toy aircraft may be incorporated in any other disclosed or described or suggested form or embodiment as a general matter of design choice. It is the intention of the applicants, therefore, to be limited only as indicated by the scope of the claims appended hereto.

We claim:

1. A model toy aircraft comprising:

a central wing comprising a substantially horizontal planar web having a front end, an aft end, a first side and a second side;

at least two pontoons, each mounted to the first and second sides of the wing so that the wing extends between the pontoons, each pontoon having an upper surface and a lower surface, a front portion and a rear portion, the lower surface of each pontoon including a step located closer to the front portion than to the rear portion;

a tail section including at least one moveable directional control surface, the tail section mounted on the aft end of the wing;

a remote control operation system mounted to the wing;

motive means connected to the remote control operation system and mounted directly or indirectly to the wing for propelling the aircraft, and a control surface control motor connected to the remote control operation system and to the at least one moveable directional control surface.

2. The model toy aircraft as claimed in claim 1, wherein each pontoon extends substantially from the front end to the aft end of the wing, and has a substantially planar and vertical inner face and an outer face inwardly inclined from top to bottom.

3. The model toy aircraft as claimed in claim 2, wherein the upper surface of each pontoon is flat and the lower surface is mostly flat, the outer face extending from the upper to the lower surface.

4. The model toy aircraft as claimed in claim 1, wherein each pontoon has a front portion including a nose, and a rear portion, the front portion being enlarged in relation to the rear portion.

5. The model toy aircraft as claimed in claim 4, wherein the front portion of each pontoon tapers inwardly towards the pontoon nose.

6. The model toy aircraft as claimed in claim 5, wherein the taper of the front portion of each pontoon is convex.

7. The model toy aircraft as claimed in claim 4, wherein the lower surface of each pontoon curves upwardly in a shallow convex curve toward the nose of each pontoon.

8. The model toy aircraft as claimed in claim 4, wherein the rear portion of each pontoon is shorter and narrower than the front portion.

9. The model toy aircraft as claimed in claim 4, wherein each of the lower surfaces of the front portion and rear portions of the pontoons are provided with a low friction, hardened, scuff and tear resistant coating.

10. The model toy aircraft as claimed in claim 9, wherein the resistant coating material is selected from a group consisting of: fiberglass, plastic and wood.

11. The model toy aircraft as claimed in claim 1, wherein the step is located at a distance of about one third of the length of the pontoon from the front portion to the rear portion.

12. The model toy aircraft as claimed in claim 1, wherein the wing has a forward angle of attack $\alpha$ that is slightly upward from horizontal.

13. The model toy aircraft as claimed in claim 12, wherein the angle of attack $\alpha$ is between about 5° and about 10°.

14. The model toy aircraft as claimed in claim 1, wherein the pontoons project forwardly of the wing.

15. The model toy aircraft as claimed in claim 1, wherein the wing is formed in the shape of a reflexed airfoil.

16. The model toy aircraft as claimed in claim 1, wherein the at least one moveable directional control surface is split into independently controllable right and left portions.

17. The model toy aircraft as claimed in claim 1, wherein the tail section includes an upper tail surface and a lower tail surface, and at least two vertical stabilizers extending upwardly from the rearmost surface of each pontoon.

18. The model toy aircraft as claimed in claim 17, wherein at least one of the upper and lower tail surfaces is split into independently controllable right and left portions.

19. The model toy aircraft as claimed in claim 17, wherein each of the upper and lower tail surfaces is split into independently controllable right and left portions, and wherein the right upper and lower surface portions are connected to each other and the left upper and lower surface portions are connected to each other.

20. The model toy aircraft as claimed in claim 17, wherein the at least two vertical stabilizers are provided with rearwardly extending, moveable control surfaces.

21. The model toy aircraft as claimed in claim 1, wherein the motive means comprises at least one motor driven propeller.

22. The model toy aircraft as claimed in claim 21, wherein the at least one motor driven propeller is mounted at the front of the aircraft.

23. The model toy aircraft as claimed in claim 21, wherein the aircraft further includes at least one propeller housing mounted adjacent to the front end of the wing, to house the at least one motor driven propeller.

24. The model toy aircraft as claimed in claim 21, wherein at least one motor driven propeller is angled downward to provide down force.

25. The model toy aircraft as claimed in claim 24, where in the downward angel of the at least one motor driven propeller is between about 1° to about 8° relative to the wing incidence.

26. The model toy aircraft claimed in claim 21, wherein the at least one motor driven propeller is mounted at the rear of the aircraft.

27. The model toy aircraft as claimed in claim 21, wherein the at least one motor driven propellers is driven by an electric motor.

28. The model toy aircraft as claimed in claim 1, wherein the aircraft further includes a housing mounted adjacent to the front end of the wing, the housing being used to contain at least a portion of the remote control operation system.

29. The model toy aircraft as claimed in claim 28, wherein the aircraft further includes a strengthening rod attached to a front edge of the housing and to the pontoons.

30. The model toy aircraft as claimed in claim 1, wherein the remote control operation system includes at least a radio receiver, a controller, and a power supply.

31. The model toy aircraft as claimed in claim 30, wherein said power supply is a rechargeable battery.

32. The model toy aircraft as claimed in claim 1, wherein the aircraft is made from rigid, lightweight foam.

33. The model toy aircraft as claimed in claim 1, wherein the aircraft further includes an out-rigger sub tail flying surface mounted on the rear portion of the pontoons.

34. The model toy aircraft as claimed in claim 1, wherein the aircraft further includes an airscoop mounted on a central section of the wing above the vertical center of gravity of the aircraft.

35. The model toy aircraft as claimed in claim 1, wherein the wing together with the outboard pontoons define a tunnel hull.

36. The model toy aircraft as claimed in claim 1, wherein the tail section spans the width of the aircraft and has a chord length of at least 20% of its span.

37. The model toy aircraft as claimed in claim 1, wherein the motive means comprises two motor driven propellers.

38. The model toy aircraft as claimed in claim 37, wherein the thrust of each propeller is independently controllable to thereby enable the use of differential thrust to turn the aircraft.

39. The model toy aircraft as claimed in claim 37, wherein one of the two motor driven propellers is mounted at an inward angle sufficient to counter the rotational forces of the propellers.

40. The model toy aircraft as claimed in claim 1, wherein the longitudinal center of gravity of the aircraft, measured from a front end of the wing, is substantially at a 25% region.

41. The model toy aircraft as claimed in claim 40, wherein the aircraft includes an air scoop and an exhaust, and wherein the air scoop, the exhaust, and the tail section are located aft of the longitudinal center of gravity of the aircraft.

42. The model toy aircraft as claimed in claim 1, wherein the motive means has a thrust line, and wherein the thrust line of the motive means is located coincident with the vertical center of gravity of the aircraft and the zero lift line of the airframe.

43. A model toy aircraft comprising:

a central wing comprising a substantially horizontal planar web having a front end, an aft end, a first side and a second side;

at least two pontoons, each mounted to the first and second sides of the wing so that the wing extends between the pontoons, each pontoon having a substantially planar and vertical inner face and an outer face inwardly inclined from top to bottom;

a tail section including at least one moveable directional control surface, the tail section mounted on the aft end of the wing;

a remote control operation system mounted to the wing;

motive means connected to the remote control operation system and mounted directly or indirectly to the wing for propelling the aircraft, and a control surface control motor connected to the remote control operation system and to the at least one moveable directional control surface.

44. The model toy aircraft as claimed in claim 43, wherein each pontoon extends substantially from the front end to the aft end of the wing.

45. The model toy aircraft as claimed in claim 44, wherein each pontoon has a flat upper surface and a mostly flat lower surface, the outer face extending from the upper to the lower surface.

46. The model toy aircraft as claimed in claim 43, wherein each pontoon has an upper surface and a lower surface, a front portion including a nose, and a rear portion, the front portion being enlarged in relation to the rear portion.

47. The model toy aircraft as claimed in claim 46, wherein the front portion of each pontoon tapers inwardly towards the pontoon nose.

48. The model toy aircraft as claimed in claim 47, wherein the taper of the front portion of each pontoon is convex.

49. The model toy aircraft as claimed in claim 46, wherein the lower surface of each pontoon curves upwardly in a shallow convex curve toward the nose of each pontoon.

50. The model toy aircraft as claimed in claim 46, wherein the rear portion of each pontoon is shorter and narrower than the front portion.

51. The model toy aircraft as claimed in claim 46, wherein the lower surface of each pontoon includes a step located closer to the front portion than to the rear portion.

52. The model toy aircraft as claimed in claim 51, wherein the step is located at about a third of the length from the front portion to the rear portion.

* * * * *